United States Patent [19]

Mizutani

[11] Patent Number: 4,664,719

[45] Date of Patent: May 12, 1987

[54] METHOD AND APPARATUS FOR CLEANING STEP BOARDS OF ESCALATOR

[75] Inventor: Tomoharu Mizutani, Nagoya, Japan

[73] Assignee: Meiso Yoko Company, Ltd., Hyogo, Japan

[21] Appl. No.: 729,238

[22] Filed: May 1, 1985

[30] Foreign Application Priority Data

Feb. 5, 1985 [JP] Japan ..... 60-20621
Feb. 8, 1985 [JP] Japan ..... 60-23971

[51] Int. Cl.[4] ..... B08B 7/00

[52] U.S. Cl. ..... 134/6; 15/250.1; 15/256.5; 474/92

[58] Field of Search ..... 198/321, 294, 296; 134/6; 15/250.1, 256.5, 160, 301, 302, 320, 321; 474/92

[56] References Cited

U.S. PATENT DOCUMENTS

| | | | |
|---|---|---|---|
| 2,060,491 | 11/1936 | Dunlop | 15/256.5 |
| 3,678,533 | 7/1972 | Cravits | 15/302 |
| 3,744,430 | 7/1973 | Zuppiger | 198/494 |
| 4,514,872 | 5/1985 | Hopkins | 198/496 |

*Primary Examiner*—Andrew H. Metz
*Assistant Examiner*—Sharon T. Cohen
*Attorney, Agent, or Firm*—Schwartz & Weinrieb

[57] ABSTRACT

A method for cleaning the step boards of an escalator and an apparatus for carrying out the method. The apparatus comprises a holding unit to be fixedly placed at the entrance or at the exit of an escalator, a cleaning unit having a driving means, a power transmitting system and rotary brushes mounted on the holding unit so as to be shiftable widthwise of the escalator, and a pressing means to move the cleaning unit so that the rotary brushes are pressed against each step board of the escalator. Each rotary brush is furnished with a plurality of rows of bristle groups extending helically over the circumference of the cylindrical body thereof, and the individual bristles of each row of the bristle group are inclined both at an angle with respect to the axial direction of the cylindrical body and at an angle with respect to the radial direction of the cylindrical body. The directions of inclination of the bristles of each bristle group with respect to the axial direction of the cylindrical body and with respect to the radial direction of the cylindrical body are opposite to the corresponding directions of inclination of the bristles of the adjacent bristle groups respectively, so that the bristles are able to brush the surfaces of the step boards, the side surfaces of the cleats of the step boards and the bottoms of the grooves between the cleats when the rotary brushes are rotated.

20 Claims, 13 Drawing Figures

METHOD AND APPARATUS FOR CLEANING STEP BOARDS OF ESCALATOR

BACKGROUND OF THE INVENTION

1. Field of the Invention:

The present invention relates to a method and an apparatus for cleaning the step boards of an escalator and more specifically to a method for cleaning the surfaces and grooves between the cleats of the step boards of an escalator by mounting a cleaning unit on a holding unit detachably placed at the entrance of an escalator, pressing rotary brushes rotatably mounted on the cleaning unit against the surfaces of the step boards of the escalator, and rotating the rotary brush in a predetermined direction as the escalator is operated so that the surfaces and the grooves between the cleats of the step boards are cleaned satisfactorily, and to an apparatus for cleaning the step boards of an escalator, including a holding unit capable of being placed detachably at the entrance of an escalator, and a cleaning unit equipped with rotary brushes and adapted to be mounted on the holding unit so that the rotary brushes can be pressed against the step boards of the escalator.

2. Description of the Prior Art:

An escalator has a plurality of step boards endlessly connected for circultion. The step boards are circulated during the operation of the escalator so that the step boards form a series of stairs of a fixed rise in the inclined section of the escalator and the rise decreases proessively as the distance to the entrance and to the exit of the escalator decreases. A comb plate is detachably provided at the entrance or at the exit of the escalator to comb the grooves between the cleats extending crosswise of the breadth of the escalator so that the feet of persons being carried are transferred safely from the step board to the comb plate.

During the operation of the escalator, highly adhesive trash such as chewing gums thrown by persons carried on the escalator and a mixture of foodstuffs, such as ice cream, as well as dust, accumulate with time and soil the surfaces of the step boards and the grooves between the cleats provided on the step boards to provide secure footholds so as to prevent people's feet from slipping. Removal of the mixtures of the highly adhesive substances and dust is extremely difficult. In the facilities of the service trade, such as department stores and hotels, a soiled appearance of the escalators is undesirable and in foodstaff sales room, in particular, dirty escalators spoil the sanitary impression of the room.

Generally, such dirty substances sticking firmly to the surface and the grooves of the cleats of the step boards are scraped off by cleaning workers with scraping tools, such as knives and scrapers, while the escalator is stopped during the closure of the facility or during the night. However, the periodical repetition of such cleaning work for numerous step boards requires much time and labor and is inefficient. Accordingly, it is a usual procedure, when all the step boards of one escalator need to be cleaned, to dismantle and to take the escalator to a service factory, where the step boards are cleaned by blowing high-pressure steam or the like against the step boards.

As mentioned above, in order to clean an escalator, it is necessary to dismantle all the step boards, to carry the same to a factory, to clean the same, and then to reassemble the escalator. Accordingly, the cleaning of a purality of escalators has required much expense, time and labor. Furthermore, since the escalator is inoperative during the period of disassembly, cleaning and reassembly (for about one week), people using the facility are obliged to suffer from inconvenience and the facility as a shop suffers from a reduction in sales.

OBJECTS OF THE INVENTION

The present invention has been proposed, in consideration of the intrinsic disadvantages of the conventional cleaning required work for cleaning the step boards of an escalator, to provide a means to satisfactorily eliminate those disadvantages.

Accordingly, it is an object of the present invention to provide a method and an apparatus for cleaning the step boards of an escalator, capable of removing foul matters sticking firmly to the surfaces of the step boards and in the grooves between the cleats of the step boards, without dismantling the step boards, which is easy, inexpensive, and efficient.

SUMMARY OF THE INVENTION

The object of the present invention is achieved by a method for cleaning the step boards of an escalator, comprising detachably fixing a holding unit at the entrance of an escalator having a plurality of step boards, mounting a cleaning means equipped with rotary brushes on the holding unit so as to be movable along the longitudinal direction of the step board, driving the rotary brushes of the cleaning means for rotation, and operating the escalator during the cleaning operation, characterized in that the rotary brushes are pressed against the step board so that the bristles of the rotary brushes will clean the surfaces of the step boards and the grooves between the cleats of the step boards.

The method of the present invention is carried out by an apparatus according to the present invention, comprising a holding unit adapted to be detachably fixed at the entrance or at the exit of an escalator, a cleaning means equipped with rotary brushes and capable of moving along the longitudinal direction of each step board, and a pressing means for depressing the cleaning means so that the bristles of the rotary brushes enter the grooves between the cleats of the step boards.

BRIEF DESCRIPTION OF THE DRAWINGS

Other objects, features and advantages of the present invention will become appararent from the following description of a preferred embodiments thereof taken in conjunction with the accompanying drawings, wherein:

FIG. 7(*b*) is a side elevation of the cleaning unit in the operating position, where the pressing means is applying an upward pressure to the cleaning unit;

DESCRIPTION OF THE PREFERRED EMBODIMENT

A method for cleaning the step boards of an escalator, according to the present invention will be described hereinafter with reference to an apparatus for cleaning the step boards of an escalator, embodying the present invention, in conjunction with the accompanying drawings.

Figure 1:
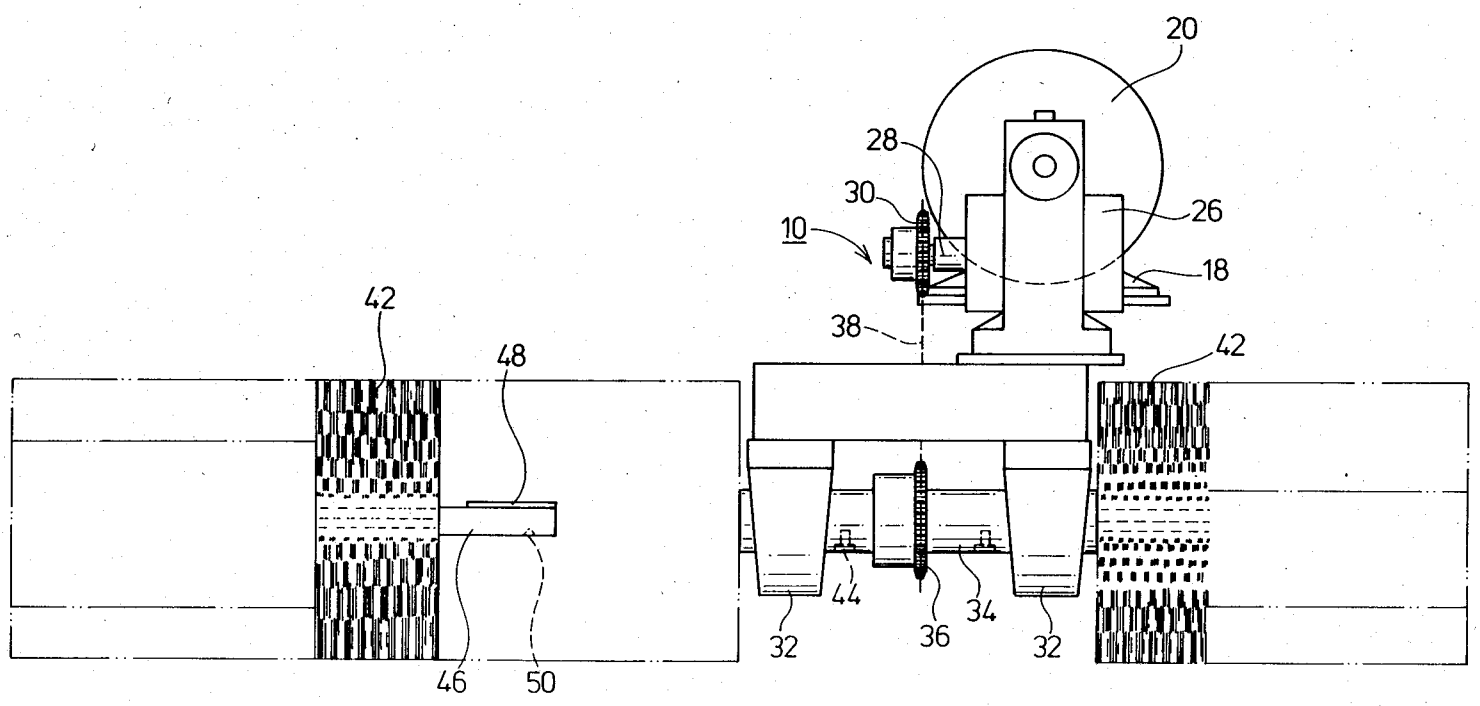
FIG. 1. is a front elevation of an apparatus for cleaning the step boards of an escalator, according to the present invention.
Figure 2:
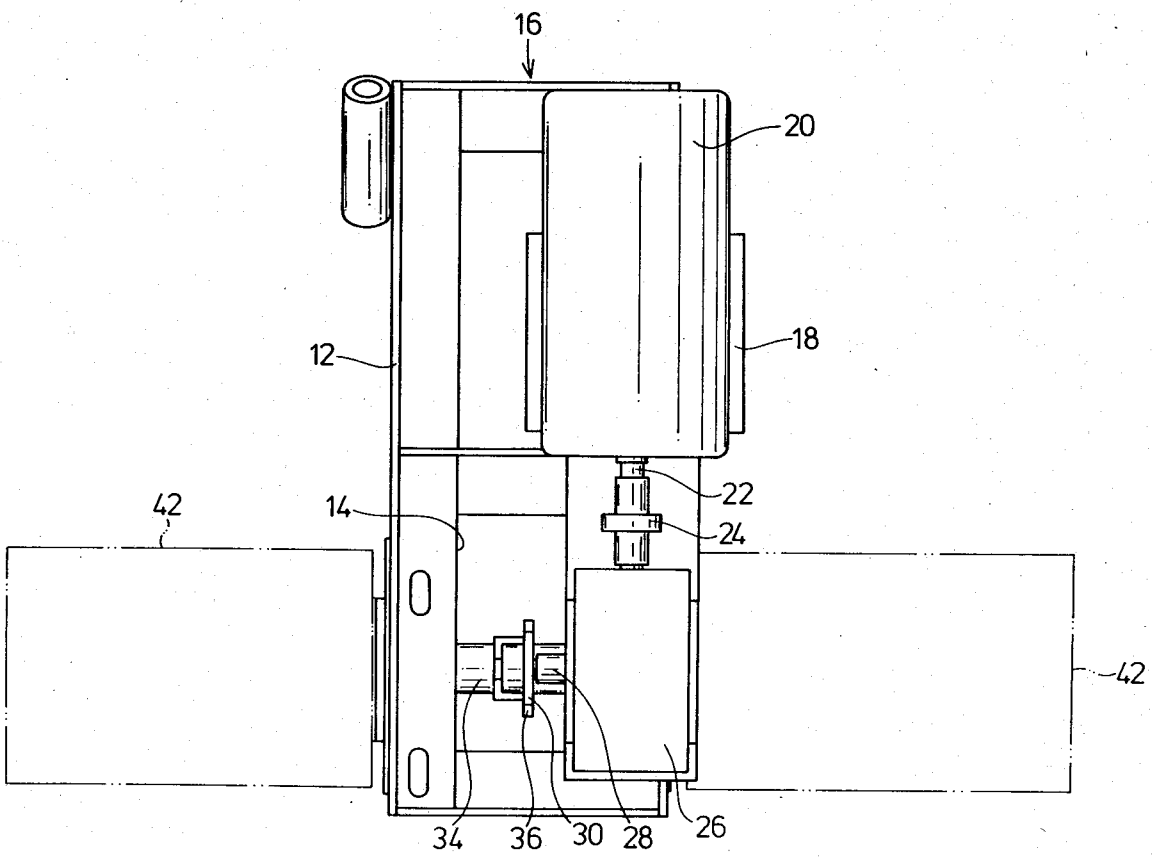
FIG. 2 is a plan view of the apparatus of FIG. 1.
Figure 3:
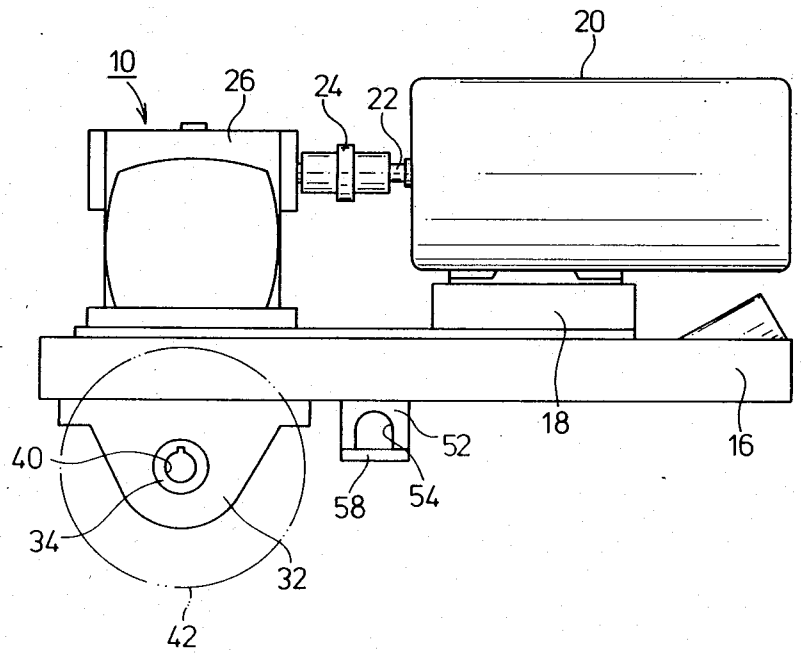
FIG. 3 is a side elevation of the apparatus of FIG. 1.

FIGS. 1, 2 and 3 are a front elevation, a plan view and a side elevation, respectively, of an apparatus for cleaning the step boards of an escalator, according to the present invention.

Referring to FIGS. 1, 2 and 3, a cleaning unit indicated generally by a reference numeral 10 has a rectangular frame 16 formed by welding L bars. The frame 16 has a rectangular opening 14. A reversible motor 20 serving as a driving source is mounted on a motor base 18 attached to the frame 16. The rotary shaft 22 of the motor 20 is connected through a coupling 24, for example, to a reduction gear 26 of the worm gear type. A sprocket 30 is secured to the output shaft 28 of the reduction gear 26.

A pair of bearing units 32 are attached to the bottom surface of the frame 16. A rotary shaft 34 is supported in the bearing units 32 so as to be rotatable about and slidable along an axis parallel to the axial direction of the output shaft 28 of the reduction gear 26. A sprocket 36 is secured to the rotary shaft 34. A chain 38 is extended through the opening 14 of the frame 16 between the sprocket 36 and the sprocket 30 secured to the output shaft of the reduction gear 26 to transmit the rotative force of the motor 20 to the rotary shaft 34. The output of the motor 20 is reduced in speed and increased in torque by the reduction gear 26 and is transmitted through a power transmission system including the chain 38 and the sprockets 30 and 36 to the rotary shaft 34 to drive the same for rotation.

As shown in FIGS. 1 and 3, bores 40 are formed in the opposite end sections, respectively, of the rotary shaft 34 so as to be coaxial with the rotary shaft 34. The stems 46 of rotary brushes 42 of a construction which will be described later are fitted in the bores 40 respectively and are detachably fixed to the rotary shaft 34 with bolts 44 screwed into the rotary shaft 34. The stem 46 of each rotary brush 42 is provided with a key 48 to inhibit the rotary movement of the stem 46 relative to the rotary shaft 34 and a recess 50 formed therein to receive the end of the bolt 44.

Figure 4:
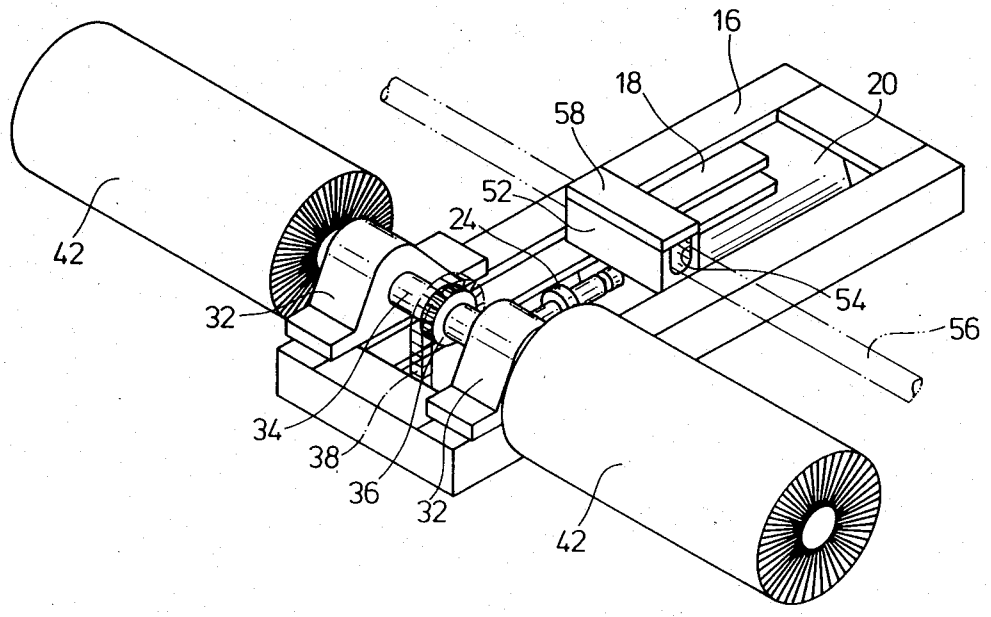
FIG. 4 is a perspective view of an apparatus of the present invention, as viewed from the bottom side thereof.

As shown in FIG. 4, a block 52 of a form as illustrated is fixed to the bottom of the frame 16 in the central section of the same. A U-shaped groove 54 is formed in the block 52 so as to extend parallel to the stems 46 of the rotary brushes 42. The U-shaped groove 54 slidably receives a guide rod 56, which will be described later. A cover 58 is detachably fixed to the block 52 so as to close the opening of the U-shaped groove 54. Accordingly, the frame 16 is able to slide on the guide rod 56 without coming off the guide rod 56.

Figure 9:
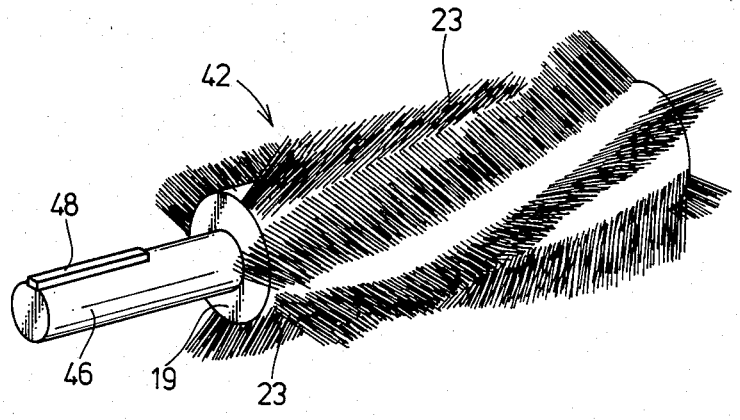
FIG. 9 is a perspective view of a preferable rotary brush employed in the preferred embodiment of the present invention.
Figure 10:
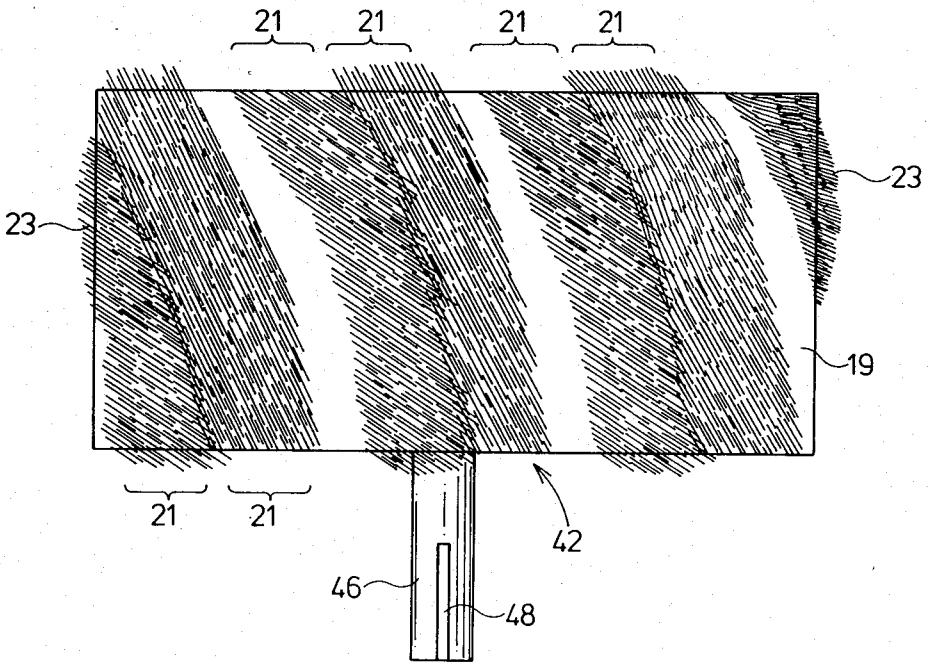
FIG. 10 is an exploded plan view of the rotary brush of FIG. 9, showing a mode of furnishing the rotary brush with bristles in detail.

The construction of the preferred rotary brush 42 employed in the embodiment of the present invention will be described hereinafter. As shown in FIGS. 9 and 10, the rotary brush 42 has a cylindrical body 19 of a suitable diameter furnished with bristles over the circumference thereof and the stem 46 is inserted and fixed to the cylindrical body 19 so as to extend coaxially with respect to the cylindrical body 19. The key 48 of a predetermined length is seated in the stem 46.

The bristles are arranged in a plurality of bristle groups 21 over the circumference of the cylindrical body 19. The bristle groups 21 extend helically over the circumference of the cylindrical body 19 at predetermined circumferential intervals. That is, a plurality of rows (six rows, in this example) of the bristle groups 21 extend helically over the circumference of the cylindrical body 19 at predetermined circumferential intervals. Nylon wires or steel wires may be used selectively as the bristles 23 of the rotary brush 42. Furthermore, strands of a resin containing abrasive grains may be employed as the bristles 23 of each rotary brush 42.

Figure 13:
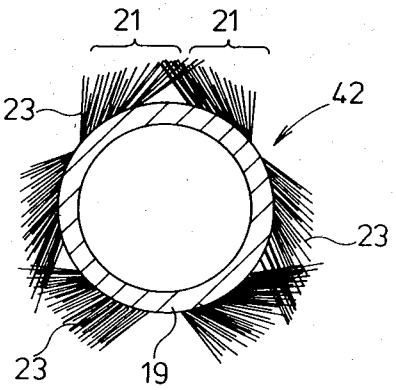
FIG. 13 is a cross-sectional view of the rotary brush employed in the embodiment of the present invention, showing a pattern of the arrangement of the bristles, in which the inclination of the bristles with respect to the radial direction of the rotary brush is reversed alternately at circumferential intervals.
Figure 11:
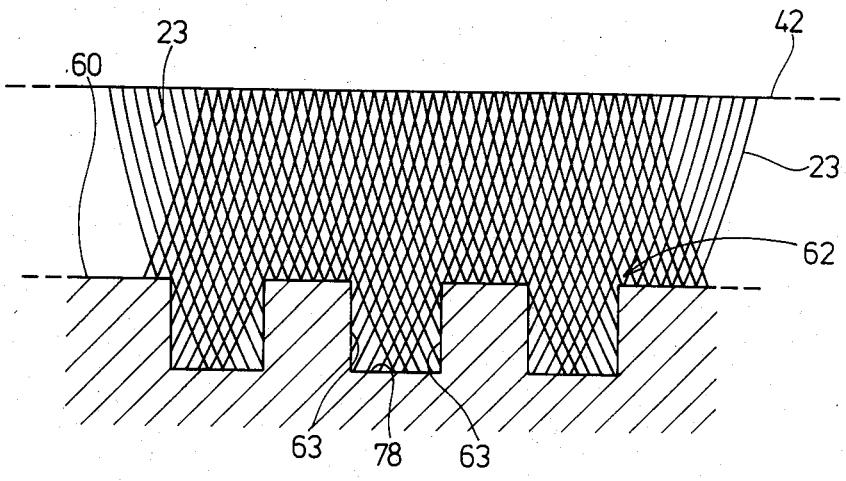
FIG. 11 is an enlarged fragmentary longitudinal sectional view of a preferred rotary brush employed in the embodiment of the present invention, showing the condition of the contact of the extremities of the bristles of the rotary brush with the vertical side walls of the cleats of the step board.
Figure 12:
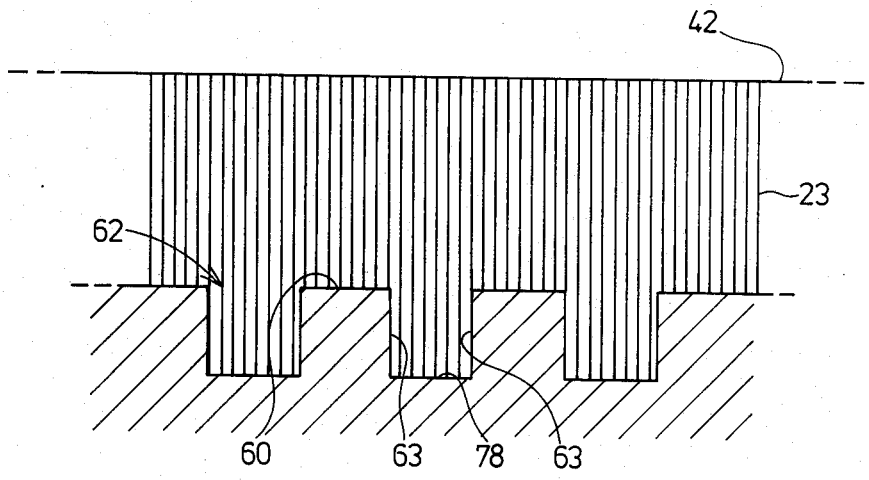
FIG. 12 is an enlarged fragmentary longitudinal sectional view of a rotary brush tested during the development of the present invention, showing the condition of the contact of the bristles of the rotary brush with the step board.

The individual bristles of each bristle group 21 are inclined regularly at a predetermined angle with respect to the longitudinal axis of the cylindrical body 19 and at a predetermined angle with respect to the radial direction of the cylindrical body 19. The directions of inclination of the bristles 23 of each bristle group 21 with respect to the longitudinal axis and with respect to the radial direction of the cylindrical body 19 are opposite to the corresponding directions of inclination of the bristles 23 of the adjacent bristle groups respectively. That is, as viewed in cross section as shown in FIG. 13, bristle groups 21 of bristles 23 extending in opposite directions of inclination are arranged alternately along the circumference of the cylindrical body 19 in a predetermined pattern. Accordingly, as shown in FIG. 11, the tips of the bristles 23 are insured of contacting both vertical side surfaces 63 of the cleats 62 of the step boards of the escalator. Therefore, when the rotary brushes 42 thus constructed are mounted on the cleaning unit of the present invention, pressed against the step boards and rotated, faulty substances adhering firmly to the vertical side surfaces of the cleats 62 are completely removed and the step boards are satisfactorily cleaned.

Figure 5:
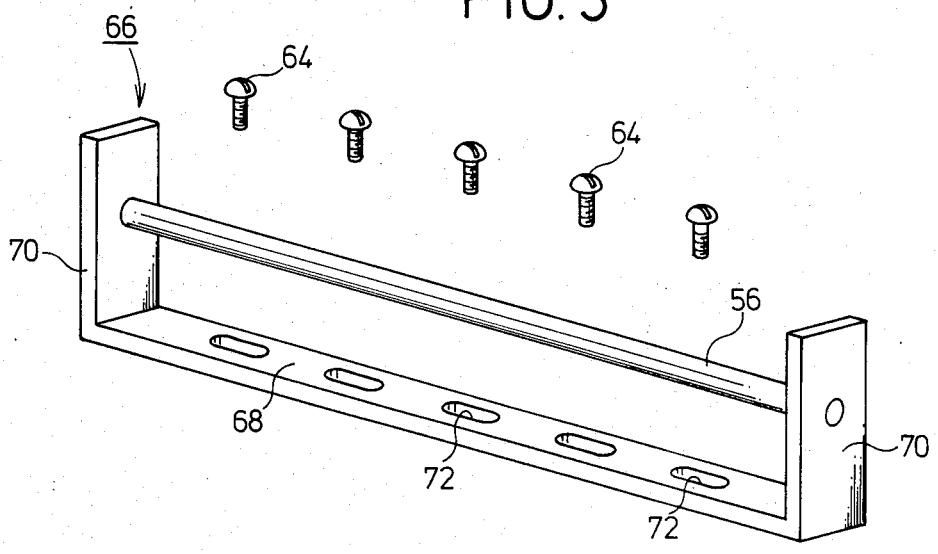
FIG. 5 is a perspective view of a holding unit for slidably holding the cleaning unit of an apparatus according to the present invention.

The procedure of cleaning the step boards of an escalator will be described hereinafter. As mentioned earlier, comb plates are provided at the entrance and at the exit of an escalator respectively to secure the safe entrance onto and exit from the escalator by people. The comb plate is formed so as to comb grooves between the cleats 62 of the step boards 60. The comb plate, not shown, is detachably fixed to the floor at the entrance or at the exit of the escalator with a plurality of screws. In cleaning the step boards, first the screws are unfastened so as to remove the comb plate, and then a holding unit 66 shown in FIGS. 5 and 6 is fixed to the floor, at the position where the comb plate was fixed with screws 64.

The holding unit 66 has a base plate 68 provided with a plurality of slots 72, and supporting plates 70 standing upright from the opposite ends of the base plate 68. The guide rod 56, for example, a round rod, is extended between the supporting plates 70. The guide rod 56 may also be a square rod.

Figure 6:
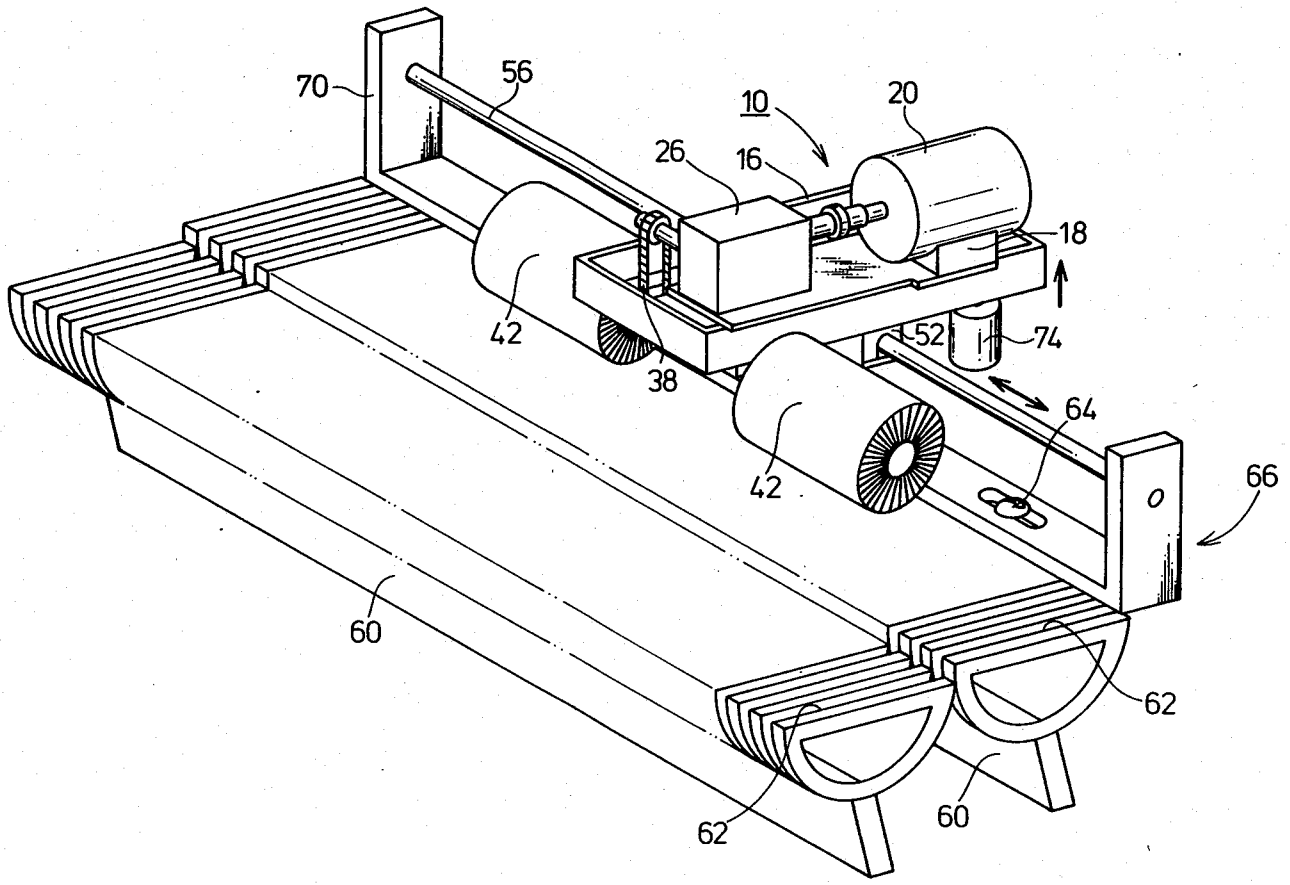
FIG. 6 is a perspective view of an apparatus according to the present invention, as placed at the entrance of an escalator in operating condition.
Figure 7A:
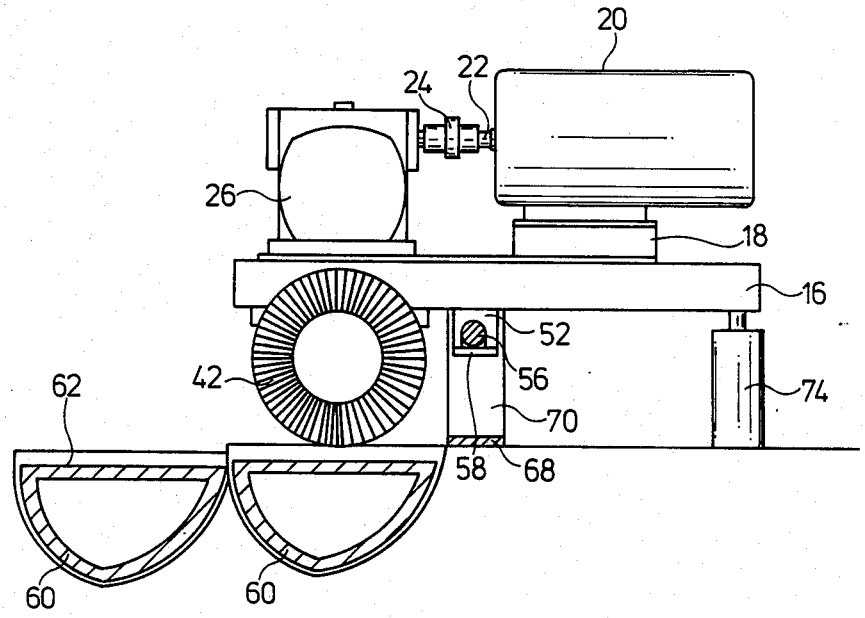
FIG. 7(*a*) is a side elevation of the cleaning unit in the unoperating position, where a pressing means is not applying any upward pressure to the cleaning unit.
Figure 7B:
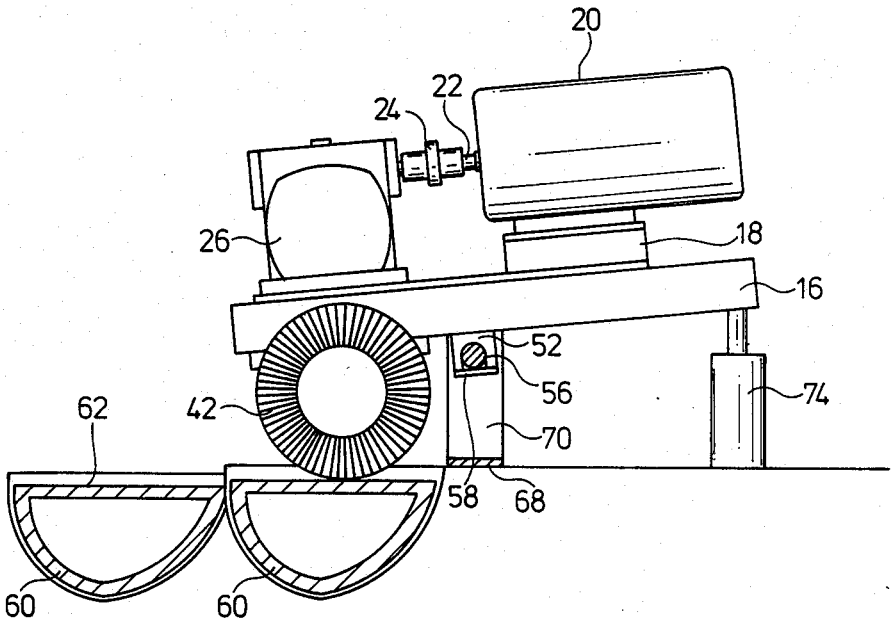

Referring to FIG. 6, the cleaning unit 10 is mounted through means of the block 52 attached to the bottom of the frame 16 on the guide rod 56 so as to be slidable therealong in the longitudinal direction of the step board 60. As shown in FIGS. 7(*a*) and 7(*b*), one end of the frame 16 opposite the other end where the rotary brushes 42 are disposed is adjustably raised by means of, for example, a hydraulic jack 74 so as to pivot the frame 16 counterclockwise, as viewed in FIGS. 7(*a*) and 7(*b*), on the guide rod 56, whereby the rotary brushes 42 are pressed against the step board 60 of the escalator. Consequently, as shown in FIG. 11, the bristles 23 of the rotary brushes 42 are forced to touch the surface of each step board 60, the side surfaces 63 of the cleats 62 and the bottoms 78 of the grooves between the cleats 62 respectively.

Figure 8A:
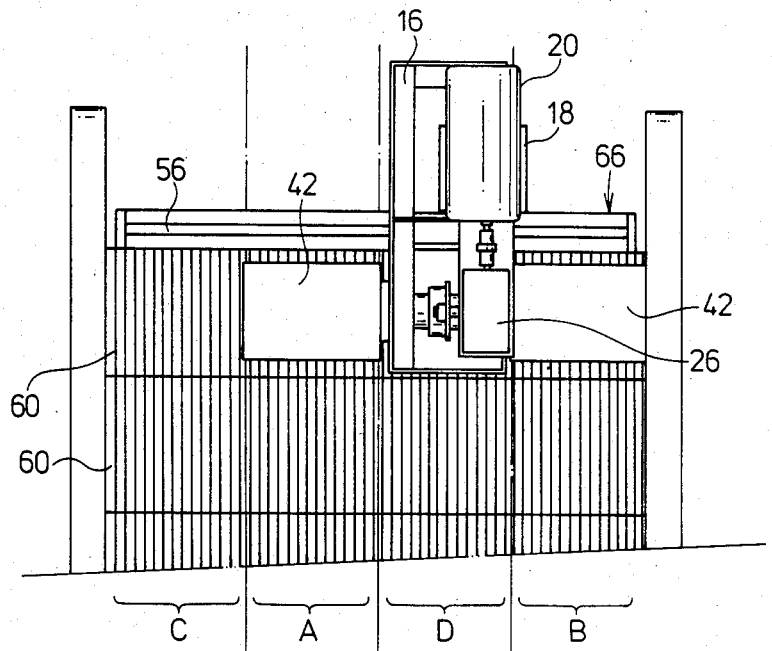
FIGS. 8(*a*) and 8(*b*) are explanatory illustrations showing the mode of the sliding movement of the cleaning unit along the longitudinal direction of the step board.
Figure 8B:
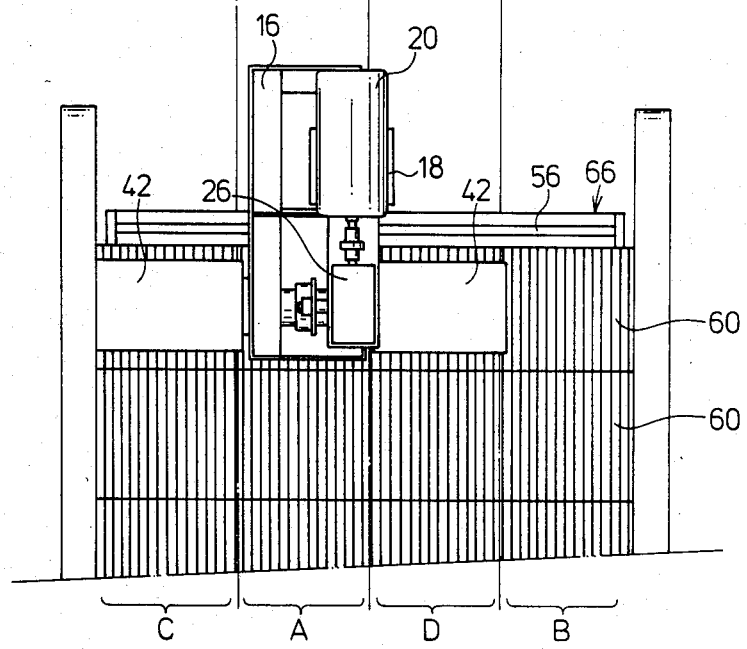

In this state, the motor 20 is actuated to drive the rotary brushes 42 for rotation and the escalator is operated. Consequently, areas in the step boards 60 corresponding to the widths of the rotary brushes 42 are cleaned. During this cleaning operation, a large amount of dust brushed off the step boards can be completely collected by means of a hood, not shown, and a vacuum suction means incorporated into the cleaning apparatus of the present invention. During the first cycle of the cleaning operation, the rotary brushes 42 brush only the areas in the step boards 60 corresponding to ranges A and B as shown in FIG. 8(*a*). After the step boards 60 have been circulated and the areas corresponding to the ranges A and B have been completely cleaned, the actuating force of the hydraulic means 74 is removed and the cleaning unit 10 is moved in the longitudinal direction of the step boards to a position shown in FIG. 8(*b*), where the rotary brushes 42 brush the areas corresponding to ranges C and D. Thus the respective entire areas of the step boards 60 are completely cleaned.

As is apparent from what has been described hereinbefore, the method and apparatus for cleaning the step boards of an escalator, according to the present invention, are capable of cleaning the surfaces of the step boards and grooves between the cleats of the step boards of an escalator within a short time while the escalator is not in use. Accordingly, it is not necessary to interrupt the operation of the escalator for cleaning while the same is in use, and hence the users are never obliged to suffer from inconvenience. Furthermore, it is necessary only to place the cleaning unit at the entrance or at the exit of an escalator for the cleaning operation and any other work is unnecessary, and thereby the cleaning expense is reduced to the minimum necessary extent.

Obviously, many modifications and variations of the present invention are possible in light of the above teachings. It is therefore to be understood that within the scope of the appended claims, the present invention may be practiced otherwise than as specifically described herein.

What is claimed is:

1. A method for cleaning the step boards of an escalator, comprising the steps of:

disposing a supporting framework upon a stationary portion of the escalator facility positioned at either the entrance or exit region of said escalator;

mounting a cleaning unit upon said supporting framework in such a manner that said cleaning unit is movable in a transverse direction across the width of said escalator, substantially perpendicular to the direction of movement of the step boards of said escalator when said escalator is in its operative mode, between at least two operative cleaning positions;

moving said cleaning unit upon said supporting framework to a first one of said at least two operative cleaning positions and engaging said cleaning unit with one of said step boards of said escalator;

operating said escalator so as to cause all of said step boards of said escalator to engage said cleaning unit whereby a first predetermined portion of each step board of said escalator will be cleaned;

stopping the operation of said escalator when all of said steps boards of said escalator have engaged said cleaning unit so as to have had their first predetermined portions cleaned by said cleaning unit;

moving said cleaning unit upon said supporting framework in said transverse direction across said width of said escalator to a second one of said at least two operative cleaning positions and engaging said cleaning unit with one of said step boards of said escalator; and operating said escalator so as to cause all of said step boards of said escalator to engage said cleaning unit whereby a second predetermined portion of each step board of said escalator will be cleaned.

2. A method as set forth in claim 1, wherein:

said cleaning unit is movable in said transverse width direction between two operative cleaning positions whereby each of said first and second predetermined portions of each of said step boards of said escalator comprises approximately one-half the surface area of said each one of said step boards of said escalator.

3. A method as set forth in claim 2, wherein:

said cleaning unit comprises a second framework of a predetermined width dimension extending in said transverse width direction of said escalator, and a pair of cleaning brushes mounted upon and extending from opposite sides of said cleaning unit second framework wherein each one of said cleaning brushes also has a width dimension extending in said transverse width direction which is substantially equal to said width dimension of said cleaning unit second framework whereby when said cleaning unit is disposed at said first one of said two operative cleaning positions, first and third quarter-sections of each of said step boards of said escalator, as defined in said transverse width direction, are cleaned, while when said cleaning unit is disposed at said second one of said two operative cleaning positions, second and fourth quarter-sections of each one of said step boards of said escalator, as defined in said transverse width direction, are cleaned.

4. A method as set forth in claim 3, wherein:

each one of said pair of cleaning brushes comprises a cylindrical brush rotatable about a horizontal axis extending substantially parallel to said transverse width direction; and each one of said pair of cleaning brushes is rotated about said horizontal axis while engaged with said step boards of said escalator so as to perform said cleaning of said step boards of said escalator.

5. A method as set forth in claim 1, wherein:

said cleaning unit is engaged with said step boards of said escalator by tilting said cleaning unit about a horizontal axis extending substantially parallel to said transverse width direction.

6. Apparatus for cleaning the step boards of an escalator, comprising:

a supporting framework secured upon a stationary portion of the escalator facility positioned at either the entrance or exit region of said escalator; and cleaning means movably mounted upon said supporting framework in a transverse direction across the width of said escalator substantially perpendicular to the direction of movement of said step boards of said escalator during said operation of said escalator between a first operative cleaning position at which said cleaning means will clean a first predetermined portion of each one of said step boards of said escalator, and a second operative cleaning position, transversely displaced from said first operative cleaning position in said width direction of said escalator, at which said cleaning means will clean a second predetermined portion of said each one of said step boards of said escalator, when said cleaning means is engaged with said step boards of said escalator during operation of said escalator for cleaning said step boards of said escalator.

7. An apparatus for cleaning the step boards of an escalator, according to claim 6, wherein each of said rotary brushes consists of a cylindrical body furnished with numerous bristles over the circumference thereof, and a stem fixed to the cylindrical body so as to extend coaxially with the cylindrical body; said rotary brush is rotated with the bristles thereof pressed against the step board of the escalator for cleaning the step board; the bristles are arranged in a plurality of rows of bristle groups helically extending over the circumference of the cylindrical body at predetermined circumferential intervals; and the bristles of each row of bristle group are inclined regularly at a predetermined angle with respect to the axial direction of the cylindrical body.

8. An apparatus for cleaning the step boards of an escalator, according to claim 7, wherein the bristles of each row of the bristle group are inclined regularly both at a predetermined angle with respect to the axial direction of the cylindrical body and at a predetermined angle with respect to the radial direction of the cylindrical body; and the directions of inclination of the bristles of each bristle group with respect to the axial direction of the cylindrical body and with respect to the radial direction of the cylindrical body are opposite to the corresponding directions of inclination of bristles of the adjacent bristle groups respectively.

9. Apparatus as set forth in claim 6, wherein:

said stationary portion of said escalator facility comprises the floor region of said facility.

10. An apparatus for cleaning the step boards of an escalator, according to claim 9, whrein said cleaning means includes:

a frame having a suitable bottom opening;

a rotative driving source mounted on the frame;

a rotary shaft rotatably supported in bearings attached to the underside of the frame;

a power transmitting means for transmitting the driving force of the rotative driving source to the rotary shaft;

rotary brushes inserted axially into the opposite ends of the rotary shaft respectively and detachably fixed thereto in place; and a block member fixed to the bottom of the frame so as to protrude downward and having a suitable form to be mounted slidably on the supporting framework fixed to the floor at the entrance or at the exit of the escalator.

11. Apparatus as set forth in claim 6, wherein said cleaning means comprises:

a second framework having a predetermined width dimension extending in said transverse width direction which is substantially equal to one-quarter the width dimension, as defined in said transverse width direction, of each one of said step boards of said escalator; and a pair of brushes mounted upon and extending from opposite sides of said cleaning means second framework and having width dimensions, as defined in said transverse width direction, substantially equal to said width dimension of said cleaning means second framework, whereby when said cleaning means is disposed at said first operative cleaning position, first and third quarter-sections of each of said step boards of said escalator, as defined in said transverse width direction, are cleaned, while when said cleaning means is disposed at said second operative cleaning position, second and fourth quarter-sections of each of said step boards of said escalator, as defined in said transverse width direction, are cleaned.

12. Apparatus as set forth in claim 11, wherein:

each of said brushes comprises a cylindrical brush rotatably mounted upon said cleaning means second framework about a horizontal axis extending in said transverse width direction.

13. Apparatus as set forth in claim 6, whereIn:

said supporting framework comprises a rod extending in said transverse width direction; and said cleaning means comprises a support block slidably mounted upon said supporting framework rod for facilitating said movement of said cleaning means upon said supporting framework between said first and second operative cleaning positions.

14. Apparatus as set forth in claim 13, further comprising:

hydraulic jack means engaged with said stationary portion of said escalator facility and said cleaning means for tilting said cleaning means about said transversely extending rod of said supporting framework so as to cause engagement of said cleaning means with said step boards of said escalator.

15. Apparatus for cleaning the step boards of an escalator, comprising:

a supporting framework secured upon a stationary portion of the escalator facility positioned at either the entrance of exit region of said escalator; and cleaning means movably mounted upon said supporting framework in a transverse direction across the width of said escalator substantially perpendicular to the direction of movement of said step boards of said escalator during operation of said escalator between a first operative cleaning position at which said cleaning means will clean a first one-half area portion of each one of said step boards of said escalator, and a second operative cleaning position, transversely displaced from said first operative cleaning position in said width direction of said escalator, at which said cleaning means will clean a second one-half area portion of said each one of said step boards of said escalator, when said cleaning means is engaged with said step boards of said escalator during operation of said escalator for cleaning said step boards of said escalator.

16. Apparatus as set forth in claim 15, wherein said cleaning means comprises:

a second framework having a predetermined width dimension extending in said transverse width direction which is substantially equal to one-quarter the width dimension, as defined in said transverse width direction, of each one of said step boards of said escalator; and a pair of brushes mounted upon and extending from opposite sides of said cleaning means second framework and having width dimensions, as defined in said transverse width direction, substantially equal to said width dimension of said cleaning means second framework, whereby when said cleaning means is disposed at said first operative cleaning position, said first one-half area portion of said each one of said step boards of said escalator comprises first and third quarter-sections of each of said step boards of said escalator, as defined in said transverse width direction, while when said cleaning means is disposed at said second operative cleaning position, said second one-half area portion of said each one of said step boards of said escalator comprises second and fourth quarter-sections of each one of said step boards of said escalator as defined in said transverse width direction.

17. Apparatus as set forth in claim 16, wherein:

each of said brushes comprises a cylindrical brush rotatably mounted upon said cleaning means framework about a horizontal axis extending in said transverse width direction.

18. Apparatus as set forth in claim 15, wherein:

said supporting framework comprises a rod extending in said transverse width direction; and said cleaning means comprises a support block slidably mounted upon said supporting framework rod for facilitating said movement of said cleaning means upon said supporting framework between said first and second operative cleaning positions.

19. Apparatus as set forth in claim 18, further comprising:

hydraulic jack means engaged with said stationary portion of said escalator facility and said cleaning means for tilting said cleaning means about said transversely extending rod of said supporting framework so as to cause engagement of said cleaning means with said step boards of said escalator.

20. Apparatus as set forth in claim 15, wherein:

said stationary portion of said escalator facility comprises the floor region of said facility.

* * * * *